United States Patent [19]

Simko et al.

[11] 4,192,099

[45] Mar. 11, 1980

[54] SWINGING DOOR STRUCTURES FOR EXTERIOR TELEPHONE BOOTHS

[75] Inventors: Paul Simko, Montreal; Albert Strasser, Coteau du Lac, both of Canada

[73] Assignee: Brass & Bronze Mfg. Co. Ltd., St. Laurent, Canada

[21] Appl. No.: 927,510

[22] Filed: Jul. 24, 1978

[51] Int. Cl.[2] ..... E05C 7/04; E05F 1/10

[52] U.S. Cl. ..... 49/366; 49/386

[58] Field of Search ..... 49/366, 386, 381, 388, 49/367, 368, 369, 9; 16/75

[56] References Cited

U.S. PATENT DOCUMENTS

| | | | |
|---|---|---|---|
| 2,878,531 | 3/1959 | Benham | 49/386 |
| 3,287,856 | 11/1966 | Passovoy | 49/381 X |
| 3,295,589 | 1/1977 | Pfleger et al. | 49/386 X |
| 3,629,972 | 12/1971 | Rehberg et al. | 49/386 X |
| 3,978,616 | 9/1976 | Pennock | 49/386 |
| 4,064,924 | 12/1977 | Catlett | 49/9 X |
| 4,122,630 | 10/1978 | Parisien | 49/386 |

*Primary Examiner*—Philip C. Kannan

*Attorney, Agent, or Firm*—Guy J. Houle; Alan Swabey; Robert Mitchell

[57] ABSTRACT

A swinging door assembly for securement in a door opening of an exterior telephone booth. A lintel member is secured in a top horizontal frame of the door opening. The lintel member has a pair of top pivot housings to receive and secure therein a top portion of a torsion spring bar located in a door column of a respective one of a pair of swinging doors. A pivot clamp bracket is secured to a lower portion of each vertical frame of the door opening. The pivot clamp bracket has a pivot pin which is received in a pivot hole in a lower end of a bearing bushing housing provided in each door column. A friction bearing assembly is supported about the pivot pin and in frictional engagement with a peripheral lower marginal edge of the pivot hole of the bearing bushing housing to frictionally retain a respective swinging door in a desired plane determined by the fixation of the top extension portion of the torsion bar of the respective swinging door.

9 Claims, 7 Drawing Figures

SWINGING DOOR STRUCTURES FOR EXTERIOR TELEPHONE BOOTHS

BACKGROUND OF INVENTION (a) Field of the Invention

The present invention relates to a swinging door assembly particularly, but not exclusively, suitable for securement in a door opening of an exterior telephone booth, the assembly being provided with friction bearing means to frictionally retain a respective one of the swinging doors in a desired plane to prevent the doors from swinging freely under the influence of light wind loads.

(b) Description of Prior Art

Exterior telephone booths of the conventional type consisting of a rectangular housing with folding type doors are known. However, the folding type doors require frequent servicing because of their many hinges, slide track, coil springs and many other movable parts and further because of vandalism. Further, these doors are not easily opened by handicapped persons because of their operational construction, particularly when a person is in the telephone booth and wishes to come out as it is often necessary to pull the panel sections of the door inwardly in order to cause the door sections to fold on their hinges. Still further, the doors can jam in partly open or fully closed positions due to snow built up or other foreign lodging in base portions of the booth. This results in further damage to the doors and the telephone equipment in the booth. Furthermore, the replacement of such doors and repairs is a time-consuming and costly operation.

SUMMARY OF INVENTION

It is a feature of the present invention to provide a swinging door assembly for use in exterior telephone booths and which substantially overcomes the above-mentioned disadvantages.

A further feature of the present invention is to provide a swinging door assembly which is easily adaptable to existing exterior telephone booths and wherein the doors are easy to open from outside or inside the telephone booth.

A further feature of the present invention is to provide a swinging door assembly for use in exterior telephone booths and wherein the construction is easy to install and to service.

According to the above features, from a broad aspect, the present invention provides a swinging door assembly particularly, but not exclusively, for securement in a door opening of an exterior telephone booth. The door assembly comprises a lintel member having a pair of top pivot housings and securable to a top horizontal frame of the door opening. Each top pivot housing lies in a respective end of the top horizontal frame. A pivot clamp bracket is secured to a respective lower portion of opposed vertical frames of the door opening. A pair of swinging doors are also provided with each door having a door column and a longitudinal vertical edge thereof. Each door column has a torsion bar located therein. The torsion bar is fixed at a lower end in a bearing bushing housing and has an upper securable extension portion which protrudes above a top end of the column. Each upper securable extension portion of the torsion bars is immovably secured in a respective one of the pivot housings. The pivot clamp bracket has a pivot pin which is received in a pivot hole in a lower end of the bearing bushing housing of a respective one of the swinging doors. A friction bearing assembly is supported about the pivot pin and in frictional engagement with a peripheral lower marginal edge of the pivot hole of the bearing bushing housing to frictionally retain a respective swinging door in a desired plane determined by the fixation of the extension portion of the torsion bar of the respective swinging door.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
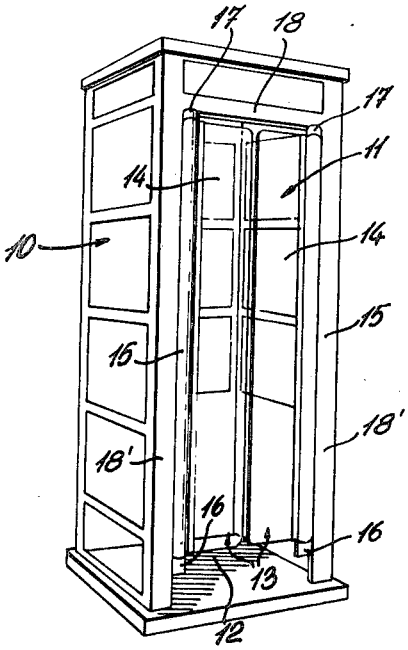
FIG. 1 is a perspective view of an exterior telephone booth having the swinging door assembly of the present invention secured therein.

Referring now to the drawings, and more particularly to FIG. 1, there is shown generally at 10 an exterior telephone booth having the swinging door assembly 11 of the present invention secured in the door opening 12 thereof. The swinging door assembly comprises a pair of swinging doors 13, each door comprising a flat door plate 14 of clear plastics material or other suitable material and each having a longitudinal vertical edge portion secured in a respective door column 15. The door column 15 is supported at a lower end on a pivot clamp bracket 16, which is fixed to a lower portion of a respective vertical frame 18', and retained at an upper end in a respective top pivot housing 17.

Figure 2:
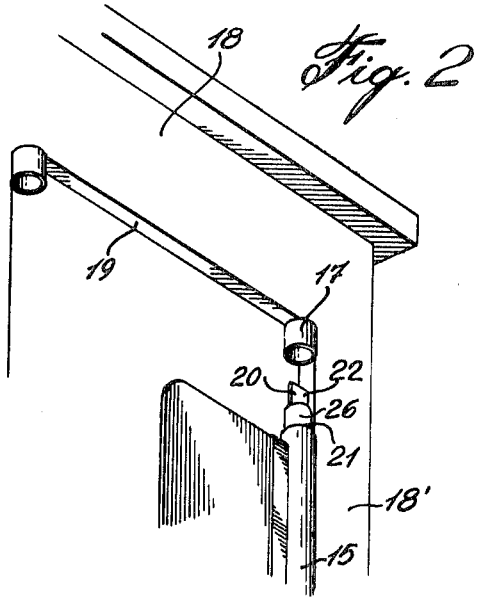
FIG. 2 is a perspective view of a fragmented top portion of the telephone booth showing the securement of the lintel member to the door opening and a swinging door in a top pivot housing.
Figure 5:
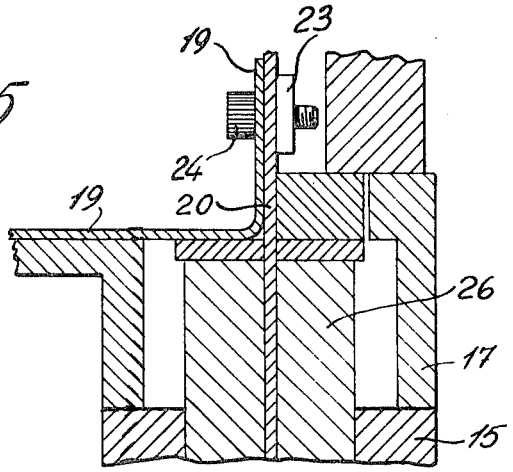
FIG. 5 is a section view showing the securement of the upper extension portion of a torsion bar through a top pivot housing.

Referring now to FIG. 2, there is shown the manner in which the top pivot housings 17 are secured to the top horizontal frame 18 of the telephone booth 10. A lintel member 19 is securable behind the top horizontal frame 18 of the telephone booth and adjacent the ends of the lintel member there is secured a respective top pivot housing 17. In each door column 15 of the swinging doors 13, there is secured an elongated torsion bar 20 which extends therein and protrudes above the top end 21 of the door column 15 to define an upper securable extension portion 22 which extends into a respective top pivot housing 17 and immovably clamped therein between a clamp bar 23 and the frame 19 (see FIG. 5) by means of clamp screws 24 extending to each side of the upper securable extension portion 22 of the torsion bar 20. A top bushing 26 is secured about the upper securable extension portion 22 for rotational fit and spacing of the bar portion 22 in a respective top pivot housing 17.

Figure 6:
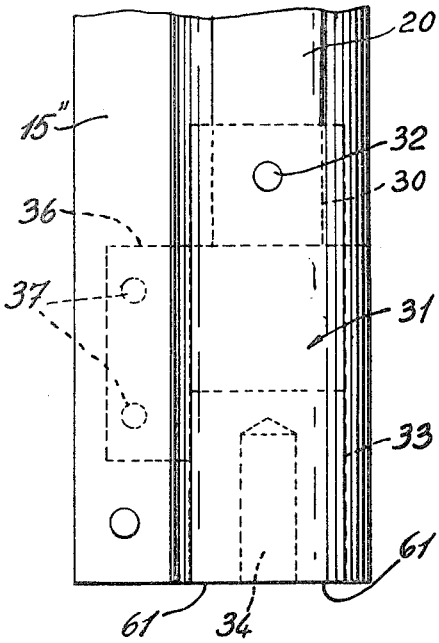
FIG. 6 is a section view showing the lower bearing bushing housing construction.

Referring now to FIG. 6, it can be seen that each torsion bar 20 is fixed at a lower end 30 in a bearing bushing housing 31 which is secured in a lower portion of the door column 15. As hereinshown, in FIG. 6 the top portion of the bearing bushing housing 31 is provided with a slot or other attachment means, which receives the lower portion 30 of the torsion bar and secured it therein by means of the screw 32. Thus, the lower portion of the torsion bar is fixed to the lower part of the door column 15 and the upper portion of the bar is fixed in the top pivot housing.

The lower bearing bushing housing 31 is provided with a pivot bearing 33 having a pivot hole 34 in a lower portion thereof which receives the pivot pin 35 (see FIG. 3) of the pivot clamp bracket 16. The bearing bushing housing 31 is fixed to the door column 15 by a securement flange 36 which is secured between the flanges 15" of the door column by the screws 37. Thus, it can be seen, that, as the swinging doors are rotated on the pivot pin 35 to twist the torsion bar 20, the torque in the torsion bar will inhibit a restoring force to assume its normal store and therefore causing the doors to swing back to their normal position of rest which is the position where there is no torque or twist in the torsion bar 20.

Figure 3:
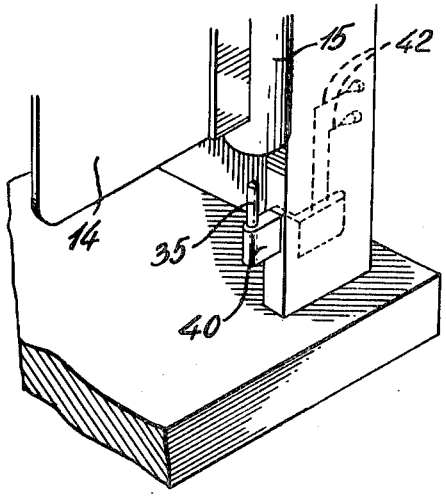
FIG. 3 is a perspective fragmented section view of a lower end of the telephone booth showing the pivot clamp bracket.
Figure 4:
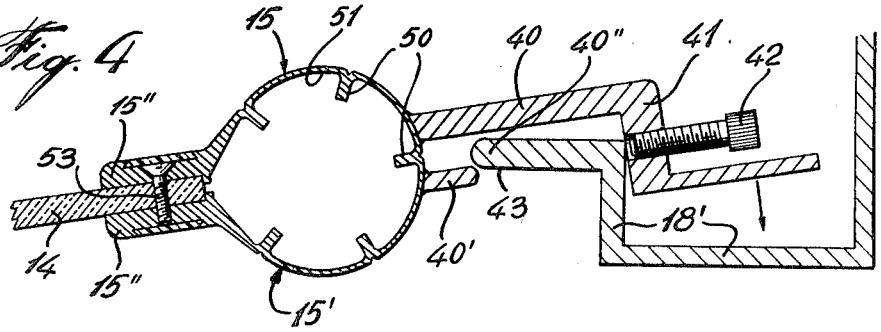
FIG. 4 is a fragmented section view showing the pivot clamp bracket and a section view of the door column supported thereby.

As seen in FIGS. 3 and 4, the pivot clamp bracket 16 comprises a clamp plate 40 having the pivot pin 35 secured vertically at a free end. A clamp section 40' is also provided at the first end to receive a forward edge 40" of a respective vertical frame 18' thereof. A clamp section 41 is provided at a second end of the clamp bracket 40 to detachably secure the pivot clamp bracket 16 to a lower portion of the opposed vertical frame 18' of the telephone booth 10. A clamp fastener 42 secures the clamp section 41 to the frame 18' as shown in FIG. 4. A cover edge plate 43 may be fastened along the protruding forward edge 40" of the side vertical frame 18' to hide any cut-outs therein caused by the previous door hinges mounted in the door opening, when the swinging doors are used as replacement doors for existing telephone booths.

Referring again to FIG. 4, there is shown the construction of the door column 15. Each door column 15 is constructed of extruded material, such as aluminum or other suitable material and defines a hollow tubular portion 15' and parallel securement flanges 15". A straight edge portion of the door panel or plate 14 extends between the securement flanges 15' and clamped between the inner face 51 of the door column. Attachment bolts 53 secure the door plate 14 to the flanges 15" of the column 15. These bolts 53 are concealed by the provision of a dove tail ended slot 52 in each outer face of the securement flanges 15". An insert strip 52' is slidingly retained in a respective slot 52 over the heads of the bolts 53 and the hole accommodating the bolts 53. Guide ribs 50 extend radially a predetermined distance from the inner face 51 of the hollow tubular portion 15' to centrally position the lower bearing bushing housing 31 within the door column 15. The securement flange 36 of the lower bearing bushing housing is secured between the securement flanges 15", as shown in FIG. 6.

Figure 7:
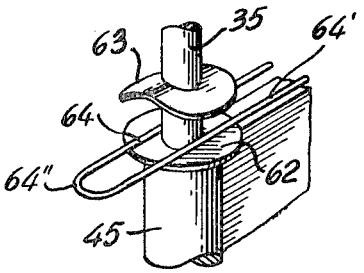
FIG. 7 is a perspective view of the friction bearing assembly.

The torsion bar 20 is constructed of suitable metal to bend under twisting force between its end, such as when a person pushes the doors 13. The torsion bar 20 will spring back to its original state after the twisting force is removed to restore the doors 13 to their initial position. The torsion bar cannot be too strong to resist slight pressure applied to the door plate 14 whereby to permit easy displacement thereof. However, in order to prevent the doors from swinging in and out due to unwanted pressures, such as light wind loads, a friction bearing assembly 60, see FIG. 7, is provided and supported about the pivot pin 35 of the pivot clamp bracket 16, and in frictional engagement with a peripheral lower marginal edge 61 of the pivot bearing 33 of the bearing bushing housing 31.

The friction bearing assembly 60 is of unique design and comprises a lower flat washer 62 which is positioned about the pivot pin 35 and rests on the upper end of the clamp plate 40 or suitably on shoulders (not shown) of a lower portion of the pivot pin 35. A downwardly bowed upper washer 63 is also provided about the pivot pin over the lower flat washer 62. In order to prevent the bowed washer 63 from deforming under the load of the door when initially positioned thereover, where excess loading may result, due to improper handling with the peripheral lower marginal edge 61 of the bearing bushing housing resting thereon, a spacer clip 64 is removably retained about the pivot pin 35 between the lower flat washer 62 and the upper bowed washer 63 to prevent distortion of the bowed upper washer under excess load that may be applied to the door. The spacer clip 64 consists of a U-shaped wire member having parallel arms 64' and an integral connecting arm 64". The parallel arms 64' extend transverse to the concave space of the bowed washer 64 to maintain the washer bowed. The pin is located mid-way of its length about the pivot pin as shown in FIG. 7 and after the door is installed the spacer clip is pulled out by the end arm 64". The bowed washer is thus under vertical load and exerts upward pressure to provide friction on the peripheral lower marginal edge 61 of the pivot bearing 33. Thus, this frictional bearing force will prevent the swinging doors from swinging under light wind loads.

It can be seen that the swinging door assembly of the present invention is easily installable in a door opening of an exterior telephone booth. Also, the swinging door assembly of the present invention provides a more aesthetic appearance to the existing exterior telephone booths.

Installation consists in removing the existing by-fold doors and the overhead track assembly of telephone booths and to install the lintel member 19 therein as shown in FIG. 2. Next, the cover edge plate 43 may be secured over the forward edge of one or both side frames 18' to conceal hinge cut-outs therein. One of the swing doors is then installed with the top portion of the torsion bar in a pivot housing making sure that this top portion is positioned and secured by the clamp bar 23. The clamp plate 40 is then installed with the pivot pin in position. Then the spacer clip 64 is removed and clamp screws 24 are loosened to allow the door 13 to rest on bowed washer 63. The clamp screws 24 are retightened and the door installation is completed. The other door is then installed in the same manner.

It is within the ambit of the present invention to provide any obvious modifications thereof, provided such modifications fall within the definition of the invention as defined by the appended claims.

We claim:

1. A swinging door assembly particularly, but not exclusively, for securement in a door opening of an exterior telephone booth, comprising:

(i) a lintel member having a pair of top pivot housings and securable to a top horizontal frame of said door opening, each said top pivot housing lying at a respective end of said top horizontal frame, (ii) a pivot clamp bracket securable to a respective lower portion of opposed vertical frames of said door opening, (iii) a pair of swinging doors each having a door column in a longitudinal vertical edge thereof;

(iv) each door column having a torsion bar therein, said torsion bar being fixed at a lower end in a bearing bushing housing and having an upper securable extension portion protruding above a top end of said column, (v) each upper securable extension portion of said torsion bars being immovably secured in a respective one of said pivot housings, (vi) said pivot clamp bracket having a pivot pin receivable in a pivot hole in a lower end of said bearing bushing housing of a respective swinging door, and (vii) a friction bearing assembly supported about said pivot pin and in frictional engagement with a peripheral lower marginal edge of said pivot hole of said bearing bushing housing to frictionally retain a respective swinging door in a desired plane determined by the fixation of said extension portion of said torsion bar of said respective swinging door.

2. A swinging door assembly as claimed in claim 1, wherein said friction bearing comprises a lower flat washer about said pivot pin, and a downwardly bowed upper washer about said pivot pin over said lower flat washer.

3. A swinging door assembly as claimed in claim 2, wherein a spacer clip is removably retained about said pivot pin between said lower flat washer and said upper washer to prevent distortion of said bowed upper washer when a respective swinging door is supported on said friction bearing assembly during installation.

4. A swinging door assembly as claimed in claim 3, wherein said spacer clip is a U-shaped wire member having parallel arms and an integral connecting arm, said parallel arms extending transverse to a concave arc defined by said bowed upper washer.

5. A swinging door assembly as claimed in claim 2, wherein each said swinging doors comprise a flat door plate having a straight edge section secured in said door column, said door column having a hollow tubular portion and parallel securement flanges, said straight edge being secured between said flanges by fasteners extending across said securement flanges in slots on an outer face of each said flanges and concealed by an insert strip, said bearing bushing housing being secured in a lower portion of said tubular portion, said torsion bar extending longitudinally in said tubular portion.

6. A swinging door assembly as claimed in claim 5, wherein said door column is constructed of extruded material, guide ribs in said tubular portion to receive said bearing bushing housing; said bearing bushing housing having an attachment flange, securable between said securement flanges, and a lower bearing insert having said pivot hole therein; a fastener in a top part of said bearing bushing housing to immovably secure a lower end of said torsion bar therein.

7. A swinging door assembly as claimed in claim 5, wherein said flat door plate is a transparent plastic plate, said door column being constructed of extruded aluminum.

8. A swinging door assembly as claimed in claim 2, wherein said pivot clamp bracket comprises a clamp plate having said pivot pin at a first end thereof, a clamp section at said first end, a second end having a clamp fastener, said clamp section receiving a forward edge of a respective one of said vertical frames, said clamp fastener being engaged with a rear wall of said respective vertical frame.

9. A swinging door assembly as claimed in claim 8, wherein said torsion bar is a flat elongated metal bar, said upper securable extension portion being received in a respective one of said top pivot housing and immovably retained in a securement slot between a clamp bar and said lintel member.

* * * * *